US005632490A

United States Patent [19]

Brown

[11] Patent Number: 5,632,490

[45] Date of Patent: May 27, 1997

[54] COLLECTION GAME APPARATUS

[76] Inventor: Thomas D. Brown, R.D. #1, Box 51D, Dunbar, Pa. 15431

[21] Appl. No.: 564,679

[22] Filed: Dec. 1, 1995

[51] Int. Cl.[6] ..... F41J 1/00; A63F 7/02; A63F 9/00

[52] U.S. Cl. ..... 273/350; 273/396; 273/402; 273/138.3; 273/445; 273/447

[58] Field of Search ..... 273/459, 445, 273/447, 448, 396, 350, 138 R, 138 A, 402, 138.3, 138.4

[56] References Cited

U.S. PATENT DOCUMENTS

| | | | |
|---|---|---|---|
| D. 265,487 | 7/1982 | Ohki . | |
| 2,130,820 | 9/1938 | Trumbull | 273/350 X |
| 3,350,097 | 10/1967 | Chevrette et al. | 273/402 X |
| 3,469,844 | 9/1969 | Sindelar | 273/350 |
| 3,989,252 | 11/1976 | Mattson . | |
| 4,039,193 | 8/1977 | Slater et al. . | |
| 4,048,731 | 9/1977 | Baguioro . | |
| 4,094,508 | 6/1978 | Kirsch . | |
| 4,177,987 | 12/1979 | Zimmerman | 273/447 X |
| 4,412,680 | 11/1983 | Zorn | 273/350 X |
| 4,961,580 | 10/1990 | Yoe et al. | 273/447 |
| 5,197,735 | 3/1993 | Land et al. . | |
| 5,342,064 | 8/1994 | Williamson et al. | 273/447 |
| 5,370,391 | 12/1994 | Hilzendeger et al. . | |
| 5,393,060 | 2/1995 | Land et al. . | |

FOREIGN PATENT DOCUMENTS

| | | | |
|---|---|---|---|
| 2626022 | 12/1977 | Germany | 273/396 |
| 1364290 | 8/1974 | United Kingdom | 273/396 |

*Primary Examiner*—Paul E. Shapiro

[57] ABSTRACT

A collection game apparatus includes a random selection assembly which includes a base portion, a distributor pipe assembly supported by the base portion, and a funnel-shaped perimeter wall supported by a top portion of the distributor pipe assembly. A plurality of objects are provided to be collected, and the objects are grouped into color coded sets. The objects to be collected are randomly distributed by the distributor pipe assembly of the random selection assembly. A plurality of containers are provided for storing and carrying objects that are collected. Preferably, the random selection assembly and the objects to be collected, which are balls, float in water. The base portion of the random selection assembly is inflatable. The distributor pipe assembly includes a pipe-support body supported by the base portion. The pipe-support body includes a riser portion supported by the base portion and a baffle plate supported by a top part of the riser portion. The baffle plate includes a plurality of pipe-receiving apertures. A plurality of pipes are supported by the pipe-support body, and each of the pipes includes a pipe inlet portion elevated above a pipe outlet portion. A ball placed at a pipe inlet portion will roll through a pipe and out the pipe outlet portion under the influence of gravity. Each pipe outlet portion is positioned with respect to the riser portion for discharge of an object from the pipe outlet portion transverse to the riser portion.

10 Claims, 3 Drawing Sheets

COLLECTION GAME APPARATUS

BACKGROUND OF THE INVENTION

1. Field of the Invention

The present invention relates generally to games and, more particularly, to games in which the object of the game is to be the first person to obtain a specified collection of game objects.

2. Description of the Prior Art

Games come in a wide variety of shapes, sizes, and objectives. There is a type of game, herein referred to as a collection game, in which the object of the game is to be the first person to accumulate or collect a specified set of game objects. For example, in the game of checkers, the object of the game is to collect all of the opponents pieces. In the card game called "war", the object of the game is to collect all of the opponents cards. In the game of "Monopoly" the object of the game is collect the most money and property. It is noted, however, that a collection game does not appear to be available for use in a water environment, such as a swimming pool. In this respect, it would be desirable to provide a collection game that can be played in a water environment such as a swimming pool.

An element in many games that are played is a random selection device. Often the random selection device is a pair of dice or a spinner. Other random selection devices include a randomly shuffled deck of cards. Such random selection devices discussed thus far involve manual manipulation, and a person need not be physically active to use the random selection device. In fact, the person can be seated and substantially inactive to use the random selection device. For purposes of overall health and physical activity, it may be desirable for a person to move one's body around when playing a collection game. In this respect, it would be desirable to provide a random selection device that is used in a collection game that requires a player to physically move around to play the game and use the random selection device.

For a collection game that is used in a swimming pool, it would be desirable if all the components of the game floated in water. This means that the random selection device as well as the objects that are collected should float in water.

A particular object that is used in many games in the ball. The ball is so common, perhaps, because of its characteristic of moving randomly and unpredictably in many instances. In this respect, it would be desirable to provide a swimming pool game that uses a floating random selection device and that uses a plurality of floating balls.

In some collection games, all players compete to collect as many as possible of a single class of items. The winner of such a game will be the person who collects the most items. In other collection games, each player has a designated class of items to collect, and the winner of the game is the first person to collect a complete set of designated items. In this respect, it would be desirable to provide a collection game that employs a random selection device that can be played either to collect the most of a single class of items or to collect a complete set of designated items.

Although it is desirable to have a collection game that uses a random selection device that can be played in a swimming pool or the like, it would also be desirable is such a game could be played on dry land as well.

In a collection game that uses different sets of items to be collected by different players, it is often desirable to differentiate between items in different sets by using color coding of items. In this respect, it would be desirable to provide a collection game that uses a random selection device in which different classes of objects to be collected are designated by color coding of the objects.

When a collection game is played indoors on a table or other horizontal surface, such as a floor, the table or horizontal surface serves as a storage area for the items that are collected. However, in a swimming pool, such a table or horizontal surface is not readily available. Therefore, for a collection game that is played in a swimming pool, it would be desirable to provide a portable container for each player so that the player can store and carry collected items during the course of the game.

Throughout the years, a number of innovations have been developed relating to games that use balls and distributor devices that distribute balls in a random manner, and the following U.S. patents are representative of some of those innovations: U.S. Pat. Nos. 3,989,252, 4,039,193, 4,048,731, 4,094,508, 5,197,735, 5,370,391, 5,393,060, and U.S. Pat. No. Des. 265,487. Although the patents cited above differ in many respects, they share some common characteristics. None of the cited patents disclose a collection game that can be played in a swimming pool, that used floating components, and that uses a floating random selection device that requires a player to move around in a swimming pool to use the random selection device.

Thus, while the foregoing body of prior art indicates it to be well known to use games that use balls and distributor devices that distribute balls in a random manner, the prior art described above does not teach or suggest a collection game apparatus which has the following combination of desirable features: (1) can be played in a water environment such as a swimming pool; (2) provides a random selection device that requires a player to physically move around to play the game and to use the random selection device; (3) provides a random selection device and objects to be collected that float in water; (4) provides a swimming pool game that uses a floating random selection device and that uses a plurality of floating balls; (5) can be played either to collect the most items of a single class of items or to collect a complete set of designated items; (6) uses a random selection device that can be used either in a swimming pool or on dry land; (7) uses color coding to designate different classes of objects to be collected; and (8) provides a portable container for each player so that the player can store and carry collected items during the course of the game. The foregoing desired characteristics are provided by the unique collection game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a collection game apparatus which includes a random selection assembly which includes a base portion, a distributor pipe assembly supported by the base portion, and a perimeter wall supported by a top portion of the distributor pipe assembly. A plurality of objects are provided to be collected. The objects to be collected are randomly distributed by the distributor pipe assembly of the random selection assembly. A plurality of containers are provided for storing and carrying objects that are collected.

Preferably, the random selection assembly and the objects to be collected float in water. The objects to be collected are balls. The base portion of the random selection assembly is inflatable.

The distributor pipe assembly includes a pipe-support body supported by the base portion. The pipe-support body includes a riser portion supported by the base portion and a baffle plate supported by a top part of the riser portion. The baffle plate includes a plurality of pipe-receiving apertures. A plurality of pipes are supported by the pipe-support body, and each of the pipes includes a pipe inlet portion and a pipe outlet portion. Each pipe inlet portion is elevated above each pipe outlet portion and is fitted into a pipe-receiving aperture in the baffle plate. As a result, a ball placed at a pipe inlet portion will roll through a pipe and out the pipe outlet portion under the influence of gravity. Each pipe outlet portion is positioned with respect to the riser portion for discharge of an object from the pipe outlet portion transverse to the riser portion. A pipe may include one or more bends between the pipe inlet portion and the pipe outlet portion.

The pipe-support body includes a longitudinal axis. The riser portion is comprised of a cylindrical wall which is positioned symmetrically around the longitudinal axis. The pipe outlet portions extend radially with respect to the longitudinal axis past the cylindrical wall. The baffle plate is a substantially flat plate and has a plurality of round pipe-receiving apertures. The perimeter wall is funnel shaped.

The objects to be collected are grouped into visually distinguishable sets. The visually distinguishable sets of the objects to be collected can be color coded.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carded out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collection game apparatus which has all of the advantages of the prior art and none of the disadvantages.

It is another object of the present invention to provide a new and improved collection game apparatus which may be easily and efficiently manufactured and marketed.

It is a further object of the present invention to provide a new and improved collection game apparatus which is of durable and reliable construction.

An even further object of the present invention is to provide a new and improved collection game apparatus which is susceptible of a low cost of manufacture with regard to both materials and labor, and which accordingly is then susceptible of low prices of sale to the consuming public, thereby making such collection game apparatus available to the buying public.

Still yet a further object of the present invention is to provide a new and improved collection game apparatus which can be played in a water environment such as a swimming pool.

Still another object of the present invention is to provide a new and improved collection game apparatus that provides a random selection device that requires a player to physically move around to play the game and to use the random selection device.

Yet another object of the present invention is to provide a new and improved collection game apparatus which provides a random selection device and objects to be collected that float in water.

Even another object of the present invention is to provide a new and improved collection game apparatus that provides a swimming pool game that uses a floating random selection device and that uses a plurality of floating balls.

Still a further object of the present invention is to provide a new and improved collection game apparatus which can be played either to collect the most items of a single class of items or to collect a complete set of designated items.

Yet another object of the present invention is to provide a new and improved collection game apparatus that uses a random selection device that can be used either in a swimming pool or on dry land.

Still another object of the present invention is to provide a new and improved collection game apparatus which uses color coding to designate different classes of objects to be collected.

Yet another object of the present invention is to provide a new and improved collection game apparatus that provides a portable container for each player so that the player can store and carry collected items during the course of the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
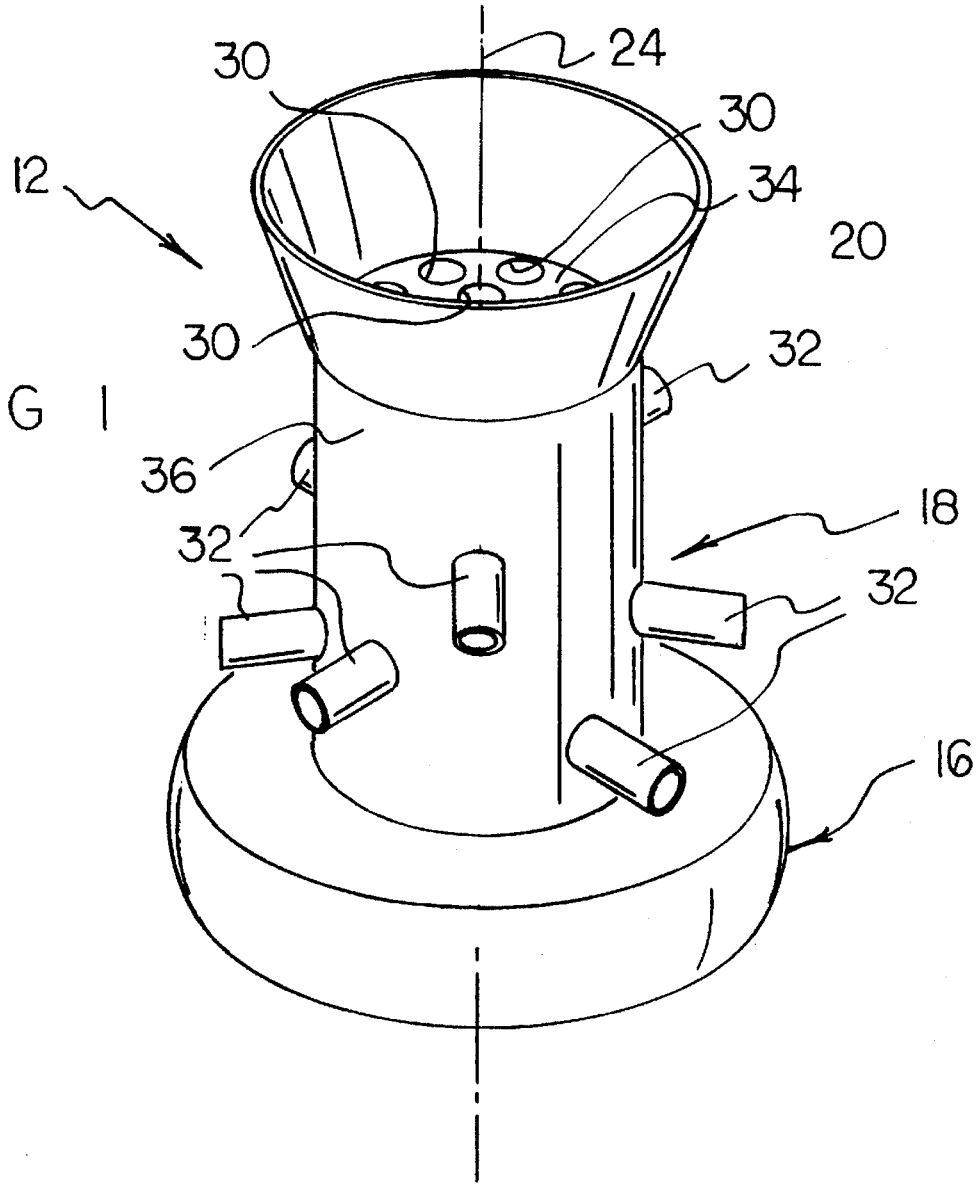
FIG. 1 is a perspective view showing a preferred embodiment of a random selection device used with the collection game apparatus of the invention.
Figure 2:
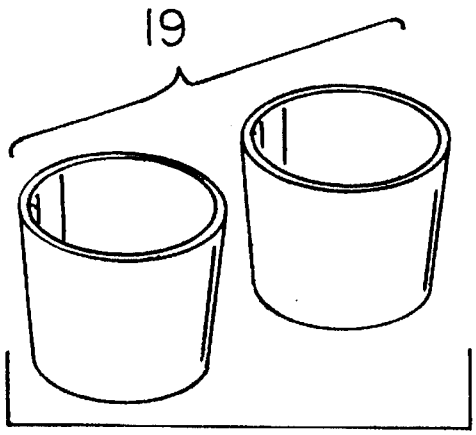
FIG. 2 is a perspective view of a pair of containers used for storing and carrying collected items used with the collection game apparatus of the invention.

With reference to the drawings, a new and improved collection game apparatus embodying the principles and concepts of the present invention will be described.

Turning to FIGS. 1–7, there is shown an exemplary embodiment of the collection game apparatus of the invention which includes a random selection assembly 12 which includes a base portion 16, a distributor pipe assembly 18 supported by the base portion 16, and a perimeter wall 20 supported by a top portion of the distributor pipe assembly 18. A plurality of objects 14 are provided to be collected. The objects 14 to be collected are randomly distributed by the distributor pipe assembly 18 of the random selection assembly 12. A plurality of containers 19 are provided for storing and carrying objects 14 that are collected.

Figure 7:
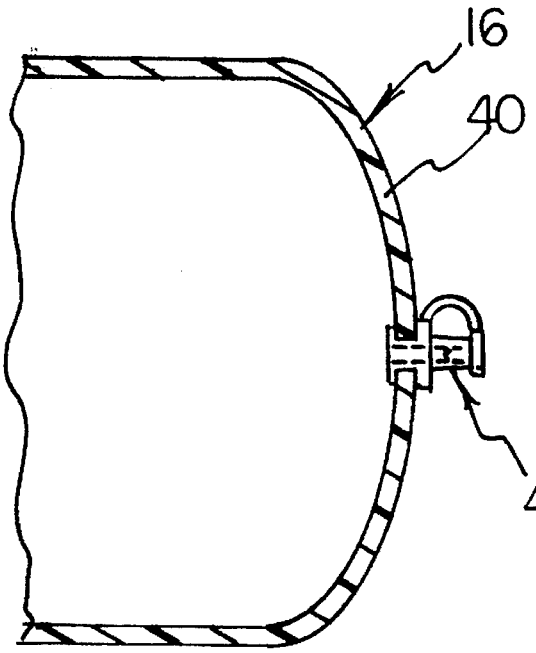
FIG. 7 is an enlarged, partial cross-sectional view of the random selection device shown in FIG. 4 taken along line 7—7 thereof.

Preferably, the random selection assembly 12 and the objects 14 to be collected float in water. The objects 14 to be collected are balls. The base portion 16 of the random selection assembly 12 is inflatable. As shown in FIG. 7, an inflatable base portion 16 includes an inflatable body portion 40 and a valve assembly 42 supported by the inflatable body portion 40. The inflatable body portion 40 can be made from flexible plastic or rubber materials.

Figure 6:
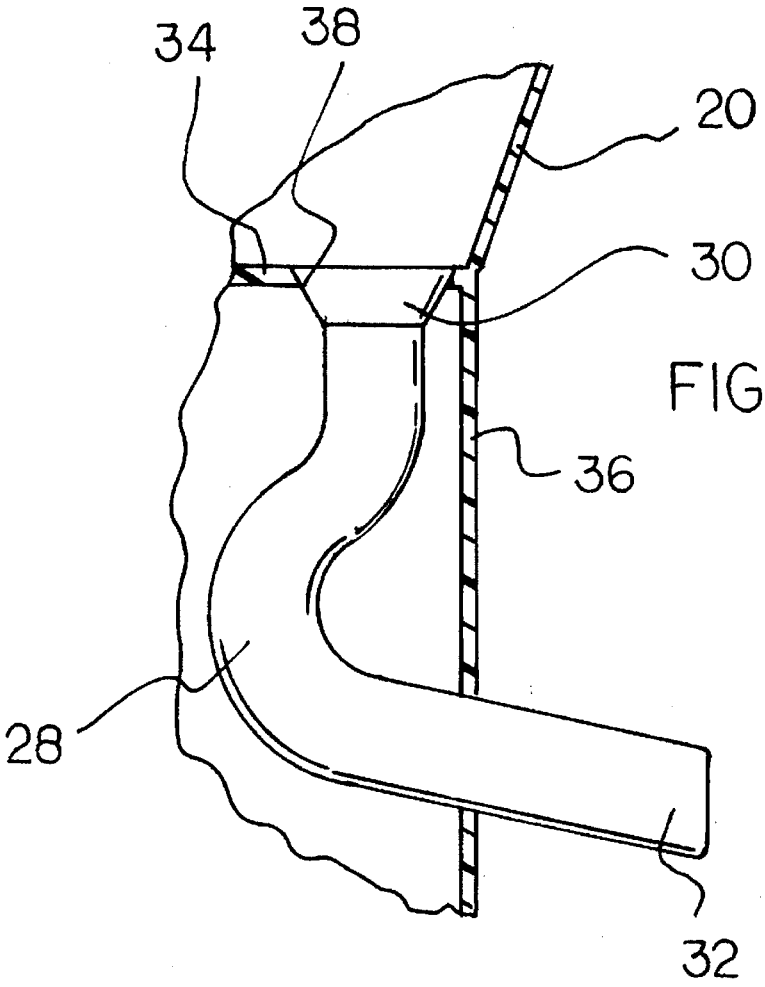
FIG. 6 is an enlarged, partial cross-sectional view of the random selection device shown in FIG. 4 taken along line 6—6 thereof.

The distributor pipe assembly 18 includes a pipe-support body supported by the base portion 16. The pipe-support body includes a riser portion 36 supported by the base portion 16 and a baffle plate 34 supported by a top part of the riser portion 36. The baffle plate 34 includes a plurality of pipe-receiving apertures 38. A plurality of pipes 28 are supported by the pipe-support body, and each of the pipes 28 includes a pipe inlet portion 30 and a pipe outlet portion 32. Each pipe inlet portion 30 is elevated above each pipe outlet portion 32 and is fitted into a pipe-receiving aperture 38 in the baffle plate 34. As a result, a ball placed at a pipe inlet portion 30 will roll through a pipe 28 and out the pipe outlet portion 32 under the influence of gravity. Each pipe outlet portion 32 is positioned with respect to the riser portion 36 for discharge of an object 14 from the pipe outlet portion 32 transverse to the riser portion 36. A pipe 28 may include one or more bends between the pipe inlet portion 30 and the pipe outlet portion 32. A pipe 28 having a plurality of bends is shown in FIG. 6.

The pipe-support body includes a longitudinal axis 24. The riser portion 36 is comprised of a cylindrical wall 36 which is positioned symmetrically around the longitudinal axis 24. The pipe outlet portions 32 extend radially with respect to the longitudinal axis 24 past the cylindrical wall 36. The baffle plate 34 is a substantially flat plate and has a plurality of round pipe-receiving apertures 38. The perimeter wall 20 is funnel shaped.

Figure 3:
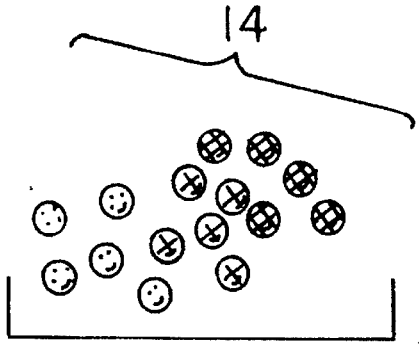
FIG. 3 is a perspective view of a set of fifteen balls provided in three visually distinguishable sets of five balls each.
Figure 4:
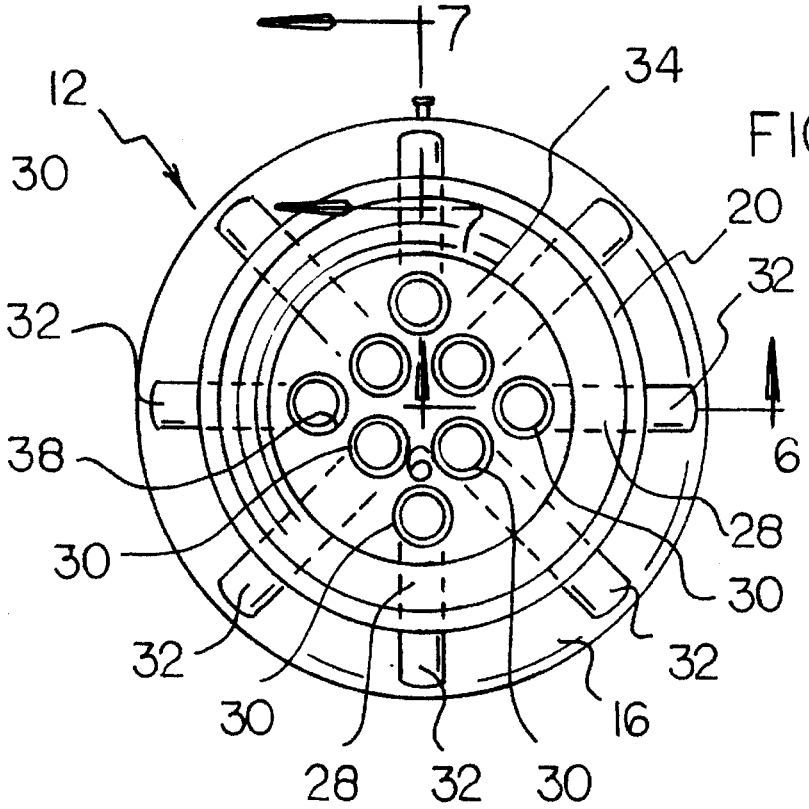
FIG. 4 is an enlarged top view of the random selection device shown in FIG. 1.
Figure 5:
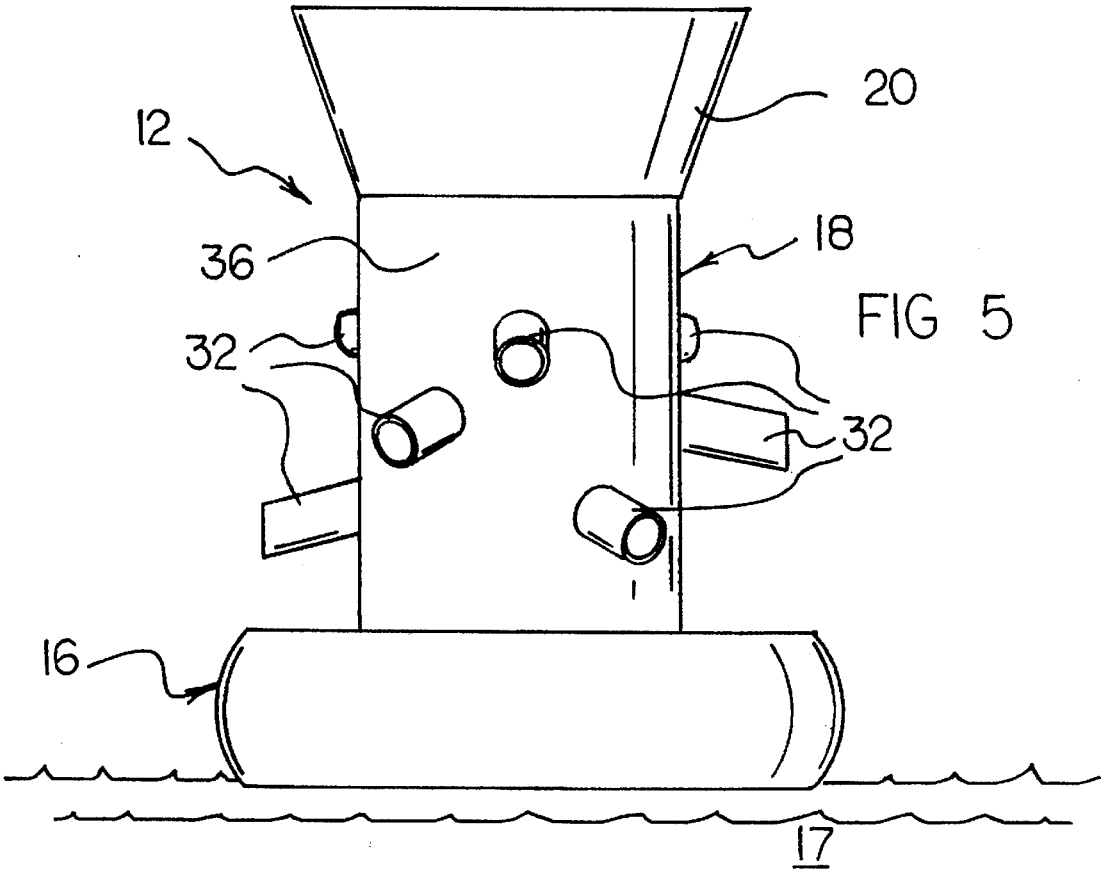
FIG. 5 is a side view of the random selection device shown in FIG. 1 floating on water.

The objects 14 to be collected are grouped into visually distinguishable sets. Three visually distinguishable sets of objects 14 are shown in FIG. 3. Five objects in one set have four dots. Five objects in another set have crosses. Five objects in another set have cross hatches. The visually distinguishable sets of the objects 14 to be collected can be color coded. The color coding can be as follows. The objects having four dots can be red; the objects having crosses can be green; and the objects having cross hatches can be blue. More groups of objects and more groups of color coding can be provided.

The collection game apparatus of the invention can be employed in a number of ways. Preferably, the base portion 16 is inflatable and floats on water 17 such as present in a swimming pool. The buoyancy of the base portion 16 is such that it supports itself, the distributor pipe assembly 18, the perimeter wall 20, and the objects 14 to be collected. Each player is provided with a set of objects 14 to be collected that are color coded. Any number of players can play. Preferably, the objects 14 are balls 14 which float in water. Each player is also provided with a container 19 which may also be color coded. To use the collection game apparatus, a collection game is played. To play the game, each player stands in the water 17 in the swimming pool. Each player then randomly tosses one of the balls 14 at a time onto the top of the pipe-support body. More specifically, the funnel-shaped perimeter wall 20 serves to funnel balls 14 from all the players thrown therein to the baffle plate 34 and to the pipe inlet portions 30 of the pipes 28. Balls 14 from all the players enter pipe inlet portions 30 in a random manner. Balls 14 from all the players travel through the pipes 28 and exit from the pipe outlet portions 32 in a random manner. Each player then seeks to collect a complete set of color coded balls 14. When the balls 14 emerge from the pipe outlet portions 32, a player will grasp any ball that can comes near the player which can be grasped. If the ball 14 is the correct color, the player places the ball 14 in the player's container 19. If the ball 14 is not the correct color, the player throws the ball 14 back into the pipe-support body.

During play of the game, any player at any time may push tangentially against either the base portion 16 or the pipe-support body to cause the distributor pipe assembly 18 to spin around the longitudinal axis 24. This spinning of the pipe-support body around the longitudinal axis 24 adds further randomness to the distribution of balls from the pipe-support body. The spinning also add velocity to the balls 14 as they emerge from the pipe outlet portions 32.

Among a group of players, the first player to gain a complete set of color coded balls 14 is the winner. The second player who gains a complete set of balls 14 is in second place, and so on. Other modes of game play can be employed when using the collection game apparatus of the invention. For example, a predetermined time period can be prescribed, and the winner is the player who gains the largest number of balls 14 in the presented time period. Another mode of play can provide that the winner is the player who first gains a set of balls 14 where each ball is a different color. Still other modes of play can be employed.

The components of the collection game apparatus of the invention can be made from inexpensive and durable metal, rubber, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved collection game apparatus that is low in cost, relatively simple in design and operation, and which may advantageously be used in a water environment such as a swimming pool. With the invention, a collection game apparatus provides a random selection device that requires a player to physically move around to play the game and to use the random selection device. With the invention, a collection game apparatus provides a random selection device and objects to be collected that float in water. With the invention, a collection game apparatus provides a swimming pool game that uses a floating random selection device and that uses a plurality of floating balls. With the invention, a collection game apparatus is provided which can be played either to collect the most items of a single class of items or to collect a complete set of designated items. With the invention, a collection game apparatus is provided which uses a random selection device that can be used either in a swimming pool or on dry land. With the invention, a collection game apparatus is provided which uses color coding to designate different classes of objects to be collected. With the invention, a collection game apparatus provides a portable container for each player so that the player can store and carry collected items during the course of the game.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A collection game apparatus, comprising:

a random selection assembly which includes a base portion, a distributor pipe assembly supported by said base portion, a perimeter wall supported by a top portion of said distributor pipe assembly, a plurality of objects to be collected, wherein said objects to be collected are randomly distributed by said distributor pipe assembly of said random selection assembly, and a plurality of containers for storing and carrying objects that are collected, wherein said distributor pipe assembly includes:

pipe-support body supported by said base portion, wherein said pipe-support body includes a riser portion supported by said base portion and a baffle plate supported by a top part of said riser portion, wherein said baffle plate includes a plurality of pipe-receiving apertures, a plurality of pipes supported by said pipe-support body, wherein each of said pipes includes a pipe inlet portion and a pipe outlet portion, wherein each pipe inlet portion is elevated above each pipe outlet portion and is fitted into a pipe-receiving aperture in said baffle plate, wherein each pipe outlet portion is positioned with respect to said riser portion for discharge of an object from said pipe outlet portion transverse to said riser portion.

2. The apparatus of claim 1 wherein said objects to be collected are balls.

3. The apparatus of claim 1 wherein said random selection assembly and said objects to be collected float in water.

4. The apparatus of claim 3 wherein said base portion of said random selection assembly is inflatable.

5. The apparatus of claim 1 wherein a pipe includes one or more bends between said pipe inlet portion and said pipe outlet portion.

6. The apparatus of claim 1 wherein:

said pipe-support body includes a longitudinal axis, said riser portion is comprised of a cylindrical wall which is positioned symmetrically around said longitudinal axis, and said pipe outlet portions extend radially with respect to said longitudinal axis past said cylindrical wall.

7. The apparatus of claim 1 wherein said baffle plate is a substantially flat plate having a plurality of round pipe-receiving apertures.

8. The apparatus of claim 1 wherein said perimeter wall is funnel shaped.

9. The apparatus of claim 1 wherein said objects to be collected are grouped into visually distinguishable sets.

10. The apparatus of claim 9 wherein said visually distinguishable sets of said objects to be collected are color coded.

* * * * *